United States Patent [19]

Barch et al.

[11] Patent Number: 4,517,916

[45] Date of Patent: May 21, 1985

[54] APPLICATOR FOR TREATING TEXTILE FILAMENTS WITH CHEMICAL TREATMENTS

[75] Inventors: Herbert W. Barch, Natrona Heights; George T. Salego, Brackenridge; Rudolph Blair, Gibsonia, all of Pa.

[73] Assignee: PPG Industries, Inc., Pittsburgh, Pa.

[21] Appl. No.: 430,162

[22] Filed: Sep. 30, 1982

[51] Int. Cl.[3] ..... B05C 1/08

[52] U.S. Cl. ..... 118/234; 118/259; 118/DIG. 20

[58] Field of Search ..... 118/234, 259, DIG. 20, 118/DIG. 15

[56] References Cited

U.S. PATENT DOCUMENTS

| | | | |
|---|---|---|---|
| 2,224,149 | 12/1940 | Fisher | 65/3 R |
| 2,272,588 | 2/1942 | Simison | 65/3 R |
| 2,300,736 | 11/1942 | Slayter et al. | 65/3 R |
| 2,728,972 | 1/1956 | Drummond | 28/1 |
| 2,968,278 | 1/1961 | Wolfe | 118/257 |
| 3,048,466 | 8/1962 | Tiede . | |
| 3,134,326 | 5/1964 | Davis | 118/259 X |
| 3,167,468 | 1/1965 | Lovelace | 161/175 |
| 3,168,389 | 2/1965 | Eilerman | 65/3 |
| 3,293,013 | 12/1966 | Drummond | 65/2 |
| 3,331,353 | 7/1967 | Sears et al. | 118/257 |
| 3,414,956 | 12/1968 | Genson | 28/59 |
| 3,498,262 | 3/1970 | Hill et al. | 118/234 |
| 3,498,263 | 3/1970 | DeToledo et al. | 118/234 |
| 3,506,419 | 4/1970 | Smith et al. | 65/3 R |
| 3,817,728 | 6/1974 | Peterson | 65/3 R |
| 3,827,397 | 8/1974 | Hebberling et al. | 118/234 X |
| 3,848,565 | 11/1974 | Schweppe | 118/234 |
| 3,920,431 | 11/1975 | Reese | 118/257 X |
| 3,951,631 | 4/1976 | Fulk | 118/261 X |
| 3,977,854 | 8/1976 | Fulmer et al. | 65/3 R |
| 4,071,341 | 1/1978 | Bohy et al. | 65/11 |
| 4,088,468 | 5/1978 | Roberson | 118/63 X |
| 4,109,610 | 8/1978 | Parbhoo | 118/202 |
| 4,115,088 | 9/1978 | Walker | 118/65 X |
| 4,222,344 | 9/1980 | Parbhoo et al. | 118/608 |

*Primary Examiner*—John P. McIntosh

*Attorney, Agent, or Firm*—Kenneth J. Stachel

[57] ABSTRACT

An applicator for use in applying chemical treatments to textile fibers is described which does not require the presence of a reservoir of the chemical treatment in close proximity to where the textile fibers are treated. The applicator has a rotating cylindrical roll which rotates continuously during application and is in rotatable horizontal attachment with a support means. The rotating cylindrical roll contacts the filaments at one portion one roll while at another portion on the roll a delivery means having a slot and cavity to which there is provided the chemical treatment is in fluid contact with the rotating applicator roll. The chemical treatment flows from the cavity through the slot and onto the rotating applicator roll to contact the textile filaments at another location on the roll. The chemical treatment is supplied to the cavity of the delivery means by a fluid control means which provides a continuous and controlled amount of the chemical treatment to the delivery means. In this manner, the precise amount of chemical treatment needed to treat the textile filaments can be applied to the cylindrical applicator roll to prevent waste of any chemical treatment. The applicator can also have a housing which surrounds the rotatable applicator roll and delivery means and provides an opening for fluid attachment between the delivery means and the fluid flow control means and also provides an opening through which a longitudinal portion of the rotatable applicating means can protrude to contact the textile filaments outside the housing. Also, in lieu of a housing, the applicator may simply have a collecting device located underneath the rotatable applicating roll and delivery means to catch any discarded chemical treatment.

9 Claims, 5 Drawing Figures

APPLICATOR FOR TREATING TEXTILE FILAMENTS WITH CHEMICAL TREATMENTS

This invention relates to an apparatus for applying a liquid chemical treatment to textile filaments and particularly, for applying liquid chemical treatments such as sizes and binders to glass fiber filaments.

In the manufacture of textiles, various chemical treatments are applied to the textile filaments. Such treatments include binders, sizes, dyes and the like. In the production of glass fibers or filaments, chemical sizes and binders are applied to protect the filaments from intrafilament abrasion, when they are gathered into strands, and to render the glass fibers compatible with matrix polymers, when the glass fibers are used as reinforcement for polymeric materials.

The chemical solutions are conventionally applied to the textile filaments using pads, rollers, sprays and belt applicators. In the manufacture of glass fibers, several various types of applicators have been used. These include belt-type applicators, transfer roll type applicators, a single roll type applicator and a roll and belt type applicator. All of these various contact type applicators are positioned in receptacles of various shapes and dimensions. These receptacles hold or contain the chemical solutions so that it can be applied to the filaments by the roller or belt applicator. Examples of such receptacles are shown in U.S. Pat. No. 3,920,431 for a roller applicator having a box-type configuration and U.S. Pat. No. 2,728,972 for a single roller applicator having a cone type lid on a box shaped applicator.

In any continuous filament production process, the filaments typically travel at high speeds during their passage over the applicator. For example, the linear speeds of the glass fibers in a high speed glass fiber production process can be on the order of 2,000 to 6,100 meters per minute or more. This high speed travel of the filaments passing over the applicator whether a roll, belt or other liquid contact applicator creates high velocity air currents in a downward direction and air is blown constantly into the receptacle of the applicator treating pressures therein. While the receptacle tends to relieve itself of pressure building at its front opening, this tends to occur intermittently so that the belt or applicator roll containing the chemical treatment may have the chemical treatment blown from place to place on the belt or roll or off the belt or roll in certain locations. This would cause the belt or roll not to have uniform quantities of the chemical treatment as it contacts the filaments, thereby, affecting the amount of chemical treatment picked up by the filaments. Further, the high velocity of the air entering the receptacle at the applicator opening tends to blow the chemical treatment back into the receptacle between the pulsating pressure cycles, which are created during these operations by the high velocity air entering and leaving the receptacle at the applicator opening. Even if the air currents rushing into the applicator did not blow the chemical treatment off the roll or belt, the rushing air causes turbulence in the reservoir of the chemical treatment from which the roll or belt picks up the film thickness of chemical treatment. These turbulence cause the chemical treatment to be picked up in varying amounts on the surface of the roller or belt application. This nonuniformity leads to variations in the amount of chemical treatment applied to the filaments. Also, the air currents cause the chemical treatment in the reservoir to be splashed on machinery and other surfaces from which the chemical treatment may be hard to remove.

It is an object of the present invention to provide an applicator that lessens the effect of air turbulence on applying chemical treatments to textile filaments and that reduces the amount of waste of the chemical treatment.

SUMMARY OF THE INVENTION

In accordance with the present invention an applicator is provided for applying chemical treatments in the liquid, emulsified, suspended or solution state to textile filaments, where the applicator does not require the presence of a reservoir of the chemical treatment. In the past a reservoir of the chemical treatment was necessary to contact a roller or belt for application of the chemical treatment to filaments which contacted the roller or belt at another location on the roller or belt from that location where the chemical treatment contacted the roller or belt. Also, the inventive applicator reduces the adverse affects of high velocity air currents produced in and about the area, where the rapidly moving continuous filaments are being treated with the chemical treatment.

In the broadest aspect of the present invention, the applicator includes a support means to which are attached a rotatable applicating means, and a delivery means, which has connected to it a fluid control means. The applicator can also have a collecting device positioned under the rotatable applicating means and the delivery means to collect any discarded chemical treatment. The support means is located in proximity to the moving continuous textile filaments so that the rotatable applicating means which is horizontally mounted for rotation in the support means can contact the moving continuous textile filaments along a longitudinal section of the rotatable applicating means. The rotatable applicating means generally has a cylindrical shape with a length sufficient to contact one or more filaments. When contacting more than one filament, the plurality of filaments may contact the rotatable applicating means in a parallel fashion or in a converging fashion, where the length of the cylinder is sufficient to contact the width of the fan of converging filaments at any appropriate location along the fan.

The delivery means is in fluid contact with the rotatable applicating means at a location on the rotatable applicating means different from where the filaments contact the rotatable applicating means. The delivery means has a slot which has a length around the width of the one or more glass fibers contacting the rotatable applicating means. When the filaments are a plurality of converging filaments, the length of the slot is similar to the width of the fan of filaments where the fan of filaments contacts the rotatable applicating means. The slot has a width sufficient to provide a meniscus of fluid chemical treatment to flow from the slot in the delivery means to the rotatable applicating means when the delivery means is in fluid contact with the rotatable applicating means. The fluid contact means that the delivery means itself does not contact the rotatable applicating means only the fluid flowing from the slot in the delivery means contacts the rotatable applicating means. The delivery means is also attached to the support means and this attachment can be a movable attachment so that the delivery means can be moved in fluid contact with the rotatable applicating means and also moved away from fluid contact with the rotatable applicating means. The delivery means is connected to a fluid control means which provides a regulated flow of fluid chemical treatment from a source to the delivery means. The delivery means generally can have a tubular cylindrical shape with the slot starting at the peripheral surface of the cylinder and continuing to the interior of the cylinder to form a cavity where the cavity is in fluid contact with the fluid control means to receive a regulated flow of the chemical treatment. Also the delivery means can have a shape adapted for placement in close proximity to a rotating applicating means which is cylindrical in shape and has flanges at either or both ends of the cylinder. In this aspect of the present invention, the delivery means would have around six sides where two opposing sides are tapered so that the side having the slot may be in fluid contact with the rotatable applicating means and the tapered sides are adjacent to the flanges of the rotatable applicating means.

When a collecting device is positioned in a spaced apart location under the rotating applicating means and the delivery means, it has a front section, back section and bottom section and two side sections adapted to receive any fluid chemical treatment which either failed to contact the rotating applicating means from the slot in the delivery means or having made such contact, fails to maintain such contact. The collecting device is supported by the supporting means and may have a drain for discarding the collected chemical treatment or for recirculating the chemical treatment to a source from which the chemical treatment is provided to the fluid control means. Also the collecting device can be a housing which surrounds the rotatable applicating means and delivery means to provide an elongated opening at the front of the housing so that the rotatable applicating means positioned adjacent to the opening can protrude through the opening to contact the continuous filaments at the surface of the rotatable applicating means where the filaments are outside of the housing. Such a housing is attached to the supporting means and can be in hinged attachment with the supporting means so that any collected chemical treatment could be dumped from time to time.

The support means and rotatable applicating means and delivery means and fluid control means associate with each other to form the applicator of the present invention. This applicator applies fluid chemical treatments to textile filaments which are generally continuously moving. The rotatable applicating means being horizontally mounted in the support means for rotation, contacts the filaments at a longitudinal portion of its cylindrical surface. At another location on the cylindrical surface of the rotatable applicating means, the delivery means which is movably mounted in the support means is moved into fluid contact with the rotatable applicating means. The fluid is able to be in fluid contact through the slot in the delivery means. The delivery means is connected to the fluid control means which is connected to a source of the fluid chemical treatment. The chemical treatment is moved from the source through the fluid control means which provides a regulated flow of the fluid chemical treatment to the cavity of the delivery means. The fluid chemical treatment flows from the cavity and through the slot in the delivery means and is picked up by the rotating rotatable applicating means. The rotating applicating means moves the fluid chemical treatment on the cylindrical surface of the rotating applicating means to the portion on the rotating applicating means that contacts the moving filaments. The moving filaments pick up the chemical treatment and move away from their contact with the rotating applicating means.

For a more complete understanding of the instant invention, reference is made to the accompanying drawings.

DETAILED DESCRIPTION OF THE INVENTION

Figures 1, 2:
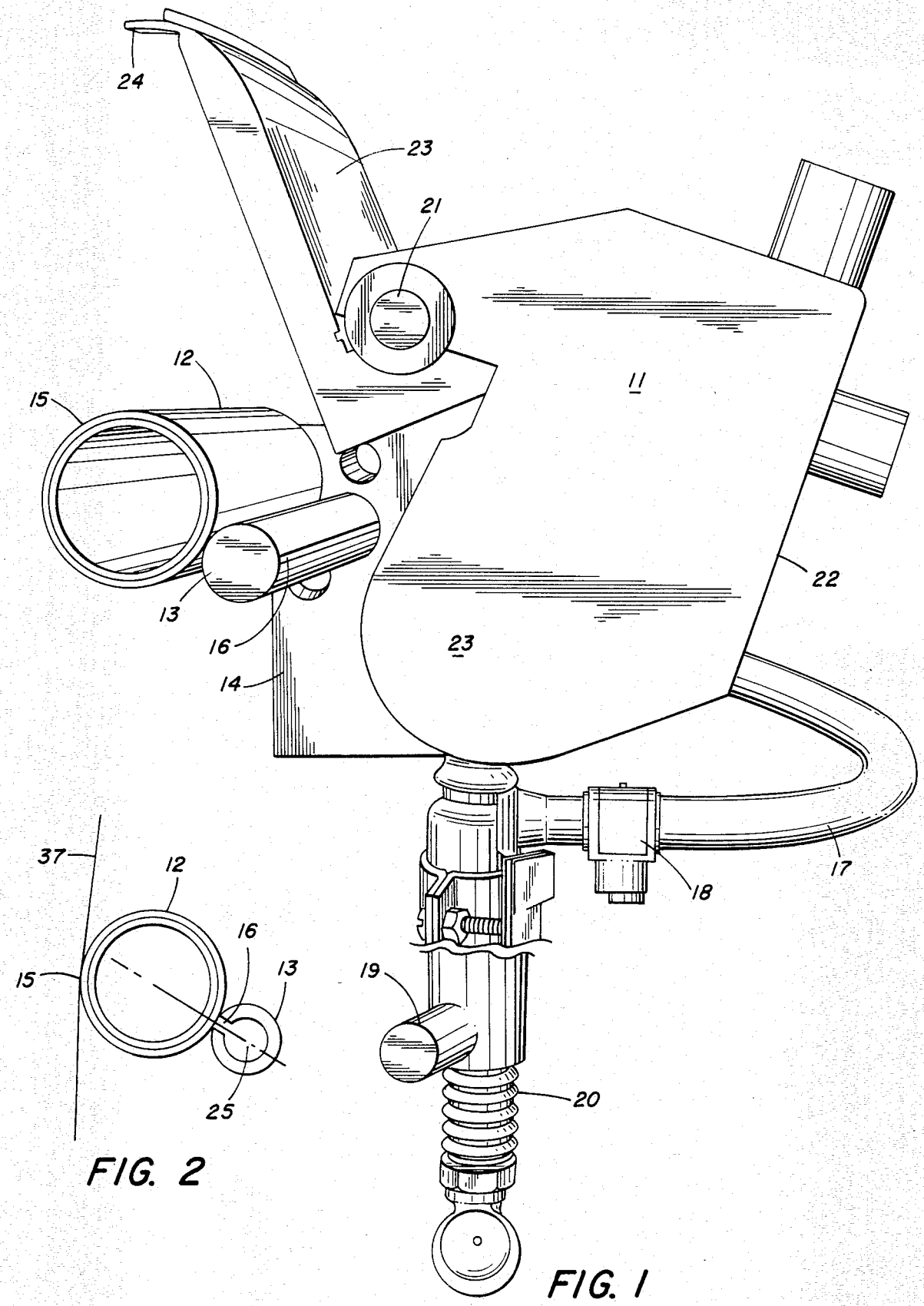
FIG. 1 is a side view of an applicator of the present invention where the delivery means is a tubular, cylindrical delivery means and the slot of the delivery means is rotated about 180 degrees from its position during use for a clear view of the slot.
FIG. 2 is a side view of the association of the delivery means with the rotating applicating means of FIG. 1.

Turning to the drawing and FIG. 1 in particular, there is shown an applicator housing 11 having a unitary bottom and side walls and top forming an enclosure having an opening at the top front of the housing. Located in the applicator is a first roller 12 which is a rotating applicator means and a second roller 13 which is a delivery means. The rotatable applicating roller is horizontally mounted for rotation in support means 14. The rotatable applicating roller is generally cylindrical in shape and can be hollow or solid. The diameter of the cylinder can range from about 0.5 inches to about 6 inches (12–153 mm.) and preferably around 2 to about 4 inches (50–102 mm.). This provides a sufficient area of contact for the moving filaments which contact the rotatable applicating means by reason of the angular direction of travel of the filaments into engagement with the cylinder such that the filaments are in arcuate contact with the periphery of the cylinder and the chemical treatment on the cylinder for a substantial distance. The filaments ordinarily contact the rotatable applicating means at a longitudinal portion of cylinder 12 around numeral 15. The rotatable applicating means rotates through its mounting in support member 14. This rotatable applicating means, as depicted in FIG. 1, is a single roller. The rotatable applicating means may also be a belt mounted for rotation about 2 shafts as is shown in U.S. Pat. No. 3,920,431 (Reese), hereby incorporated by reference. The rotatable applicating means 12 of FIG. 1 is preferably a single roller. A longitudinal section of the rotatable applicating means 12 occupies or protrudes from, preferably the latter, the opening in the front of housing 11. When the rotatable applicating means occupies the opening, it is meant that the applicating means has sufficient room to rotate within the housing and is adjacent to the opening. Therefore, the dimensions of the rotatable applicating means should be slightly less than the dimensions of the opening. The length of the rotatable applicating means 12 can vary depending upon how many filaments are to be treated. The length should be sufficient to transfer chemical treatment on the surface of the cylinder to all of the filaments that contact the surface of the cylinder. The length of the cylinder can be sufficient to treat the filaments contacting it with the chemical treatment where the filaments contact in parallel array or in a converging arrangement such as a fan where the width of the fan is less than the length of the cylinder. The cylindrical roller 12 can be made of any noncorroding steel material such as the preferred steel material, stainless steel. But, the cylindrical roll may also be made of other noncorrosive materials such as graphite, hardened carbon steels such as tin-plated or chrome-plated carbon steels, aluminum, tin-plated and chrome-plated copper, tin or chrome-plated brass and thermoset polymeric materials like phenol formaldehyde condensate polymers.

The delivery means 13 can be any shape but as depicted in FIG. 1 is a tubular, cylindrical shape. The delivery means 13 has slot 16 which as shown in FIG. 1 is rotated 180 degrees from its usual position. During use of the applicator, the slot is located on that portion of the delivery means 13 which is almost contacting rotatable applicating means 12. Delivery means 13 can have any other shape which can accommodate a slot. The delivery means 13 is supported by support means 14 to be in fluid contact with the rotatable applicating means 12. The fluid is the chemical treatment which is to be applied to the surface of the rotatable applicating means for transfer to continuous textile filaments contacting the rotatable applicating means 12 along longitudinal section 15. The fluid contact enables chemical treatments supplied to delivery means 13 to flow through slot 16 and contact rotatable applicating means 12. The chemical treatment is supplied to the delivery means 13 through conduit 17. The connection between the delivery means 13 and conduit 17 is a usual conduit type attachment such as attachment 18. The conduit and attachment attaches to delivery means 13 through support means 14. The conduit supplies the chemical treatment to the hollow interior cavity of delivery means 13 and the chemical treatment flows from the hollow area through slot 16. The fluid chemical treatment is provided from source 19 through fluid control means 20. The fluid control means 20 can be any device to apply pressure to the fluid chemical treatment for it to travel through conduit 17. Examples of fluid control devices include pumps such as centrifugal pumps, magnetic drive centrifugal pumps, submersible pumps, positive displacement pumps, metering pumps and impeller pumps and pressure and vacuum pumps and any other device that would provide force to move the fluid through a conduit. If the fluid flow is not adequately controlled by pump 20, the pump can be a metering pump as is preferred, or the conduit between pump 20 and conduit 17 can have a pulse dampener control valve inserted to control the flow of the chemical treatment through conduit 17. A suitable pulsation dampener is a polypropylene dampener available from Vanton Pump and Equipment Corp., Hillside, N.J. for a Vanton pump under catalog number XBPY6.

The housing 11 is attached to support means 14 through hinged joint 21. When the housing is closed so that the bottom section 22 of the housing is underneath the rotatable applicating means and delivery means the top section 23 of the housing rests on side 23 and the opposing side not shown in FIG. 1. The lip 24 does not meet the front of the housing and provides an opening through which the rotatable applicating means 12 protrudes.

As can be seen in FIG. 2, the roller applicating means 12 is in fluid contact with delivery means 13 so that slot 16 allows fluid to pass from the cavity 25 of delivery means 13 to contact the surface of the rotatable applicating means. When the rotatable applicating means rotates, it picks up the fluid and transfers it to the opening of the housing where the one or more filaments 37 contact the rotatable applicating means which is depicted in FIG. 2 at point 15.

In the following figures, the like reference numbes to FIGS. 1 and 2 refer to like parts throughout.

Figure 3:
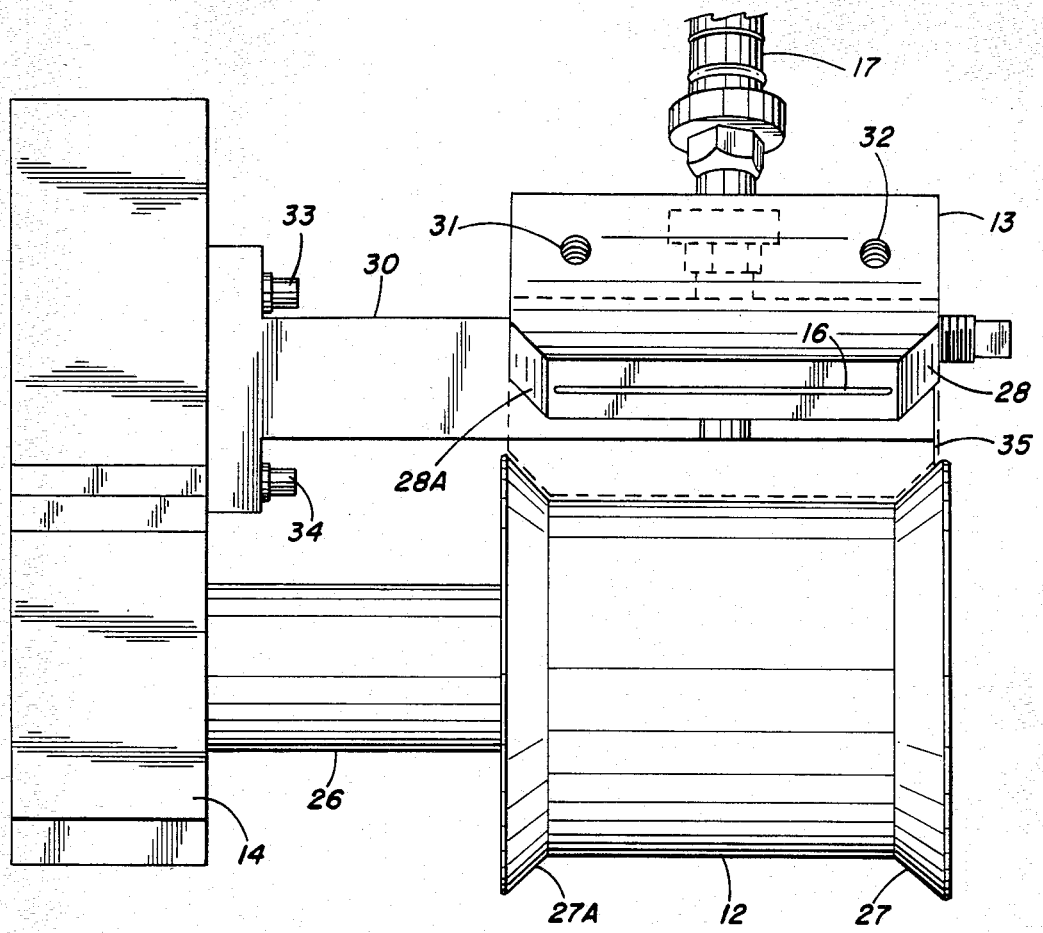
FIG. 3 is a top view of the supporting, rotating applicating means and delivery means moved away from fluid contact with the rotating applicating means but showing the position of fluid contact in phantom.

Turning to FIG. 3, there is shown the supporting means, rotatable applicating means and delivery means of the preferred embodiment of the present invention. The supporting means 14 supports the rotating applicator means 12 by rotatable shaft 26 which is rotatably mounted in the support means. The support means can be any metallic or similarly rigid body to which other metal or rigid bodies can be mounted and attached. The rotating applicator means 12 has a diameter greater than the rotating shaft 26 where the diameter of the rotating applicator means is from around 1 inch to about 6 inches and preferably 2 to 4 inches. The rotating applicating means is of a cylindrical shape as is shown in the top view of FIG. 3. Once again, the length of the surface of the cylindrical rotating applicator means is that sufficient to allow for contact by all of the continuous textile filaments to be treated with the chemical treatment. The cylindrical rotating applicator means 12 has a flange at each end of the cylinder, flange 27 and 27A respectively. The flanges are used to assist in containing the chemical treatment placed on the surface of the cylindrical applicator means from flowing off the ends of the surface of the cylindrical applicator means.

The delivery means 13 in in the preferred embodiment has a shape which is generally rectangular with two tapered opposing corners on the same longitudinal side of the rectangle. The tapered corners 28 and 28A are used to allow the delivery means 13 to come in fluid contact with the cylindrical surface of the rotatable applicating means 13 within flanges 27 and 27A. Here the delivery means has slot 16 which has the same length as the longitudinal cylindrical surface of the rotatable applicating means from the inside of one flange to the inside of the other flange. The delivery means 13 is attached to the support means 14 through attachment member 30. The attachment member 30 can have suitable fastening devices as would delivery means 13 such as fastening receptacles 31 and 32 shown in FIG. 3 with which any fastener can be used. Although FIG. 3 shows the movability of the delivery means 13 on the attachment member, the whole attachment member can be fixedly attached to the delivery means 13 and the attachment member 30 would be in movable connection with support means 14 through fasteners 33 and 34. In FIG. 3, the location of the delivery means 13 is moved back from fluid contact with rotatable applicating means 12. The phantom lines 35 show the actual fluid contact positioning of the delivery means with the rotatable applicating means. To the delivery means 13 there is attached conduit 17 which provides chemical treatment from the fluid control means not shown in FIG. 3. When the delivery means is moved into fluid contact position with the rotatable applicating means 12, the fluid chemical treatment is provided through conduit 17 at a controlled flow into the cavity of delivery means 13 and through slot 16 onto the cylindrical surface of rotatable applicating means 12. The rotatable applicating means 12 then rotates to transfer the chemical solution on its surface to a location away from the fluid contact location between rotatable applicating means 12 and delivery means 13. This transfer enables the chemical treatment to be placed at the disposal of textile filaments which contact the rotating applicating means 12.

Figure 4:
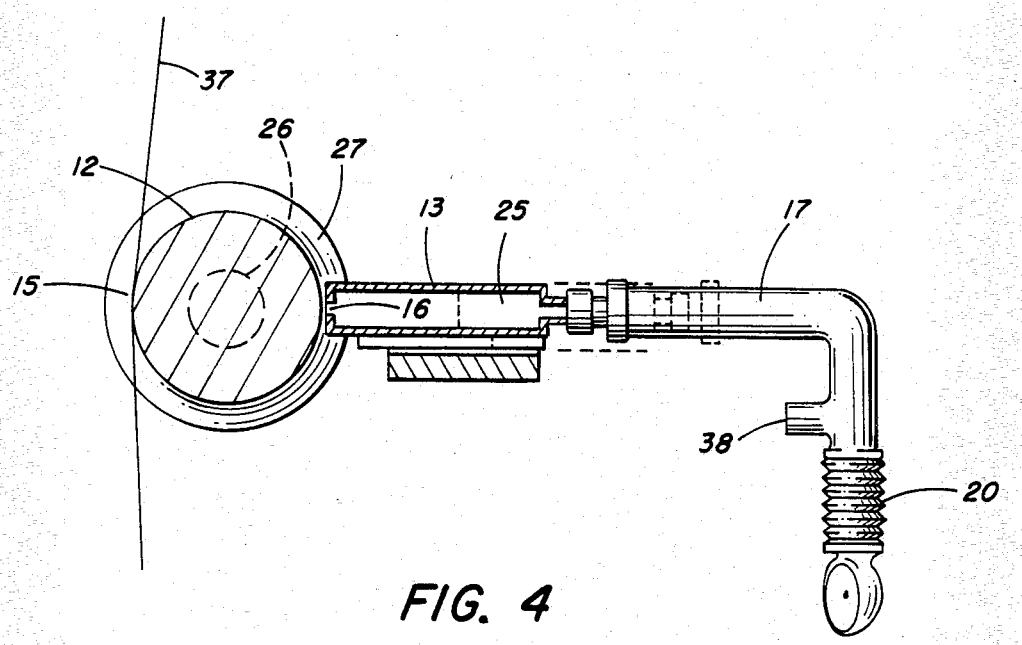
FIG. 4 is a side view of the rotating applicating means and delivery means of FIG. 3 where the delivery means is in fluid contact with the rotating applicating means and the position of the delivery means moved away from the rotating applicating means is shown in phantom.

As can be seen from FIG. 4, the delivery means 13 is in fluid contact with the cylindrical surface of the rotating applicator means 12 within flange 27 as is shown in the side view of FIG. 4. In FIG. 4, the nonfluid contacting position of the delivery means to the rotating applicator means is shown in phantom. The fluid contact is generally a gap between the rotatable applicating means 12 and the delivery means 13 of around 0.001 inch. The slot 16 of delivery means 13 is shown to be in fluid contact with rotatable applicating means 12 which is connected to rotatable shaft 26 depicted in FIG. 4 in phantom. FIG. 4 also shows a cutaway portion of the delivery means 13 to show cavity 25 which contains the chemical treatment before it flows through slot 16 onto a longitudinal portion of the cylindrical surface of the rotating applicator means 12. The textile filaments 37 contact the rotating applicator means at point 15. The fluid chemical treatment is transferred from the point of fluid contact with the delivery means 13 to location 15 where the chemical treatment comes in contact with the continuous textile filaments.

The chemical treatment is supplied to the cavity of delivery means 13 by conduit 17. Conduit 17 is attached to fluid control means 20 which is preferably a metering pump which obtains the chemical solution from a source through conduit 38. Although FIG. 4 depicts a bellows-type metering pump, any type of metering pump can be used such as piston and diaphragm type metering pumps. These pumps displace a precise volume of liquid with each cycle. During the suction stroke, the liquid chemical treatment is pulled into the pump cavity past an inlet check valve and during a discharge stroke, the inlet check valve closes and the outlet valve opens and the liquid chemical treatment is pushed out into conduit 17. The inlet and outlet check valves not shown in FIG. 4 provide for the chemical treatment to be brought into the pump via conduit 38 and to be expelled from the pump via conduit 17 to flow into cavity 25 of the delivery means 13. The flow of the chemical treatment can be varied either by changing the stroke length or adjusting the frequency of cycles within the metering pump. Preferably, the metering pump or any other fluid control means provides a pressure to the chemical treatment of around a maximum of 100 psi although higher pressures can be used if appropriate tubing is used. Also the fluid control means preferably provides a flow rate of the chemical treatment of around 22.8 to 2,080 milliliters per minute where the pump has an rpm of about 1 to about 600. The drive for the fluid control means or pump is sufficient to permit such an rpm range. Such pumps are available commercially from the Cole-Parmer Instrument Co., Chicago, Ill.

Figure 5:
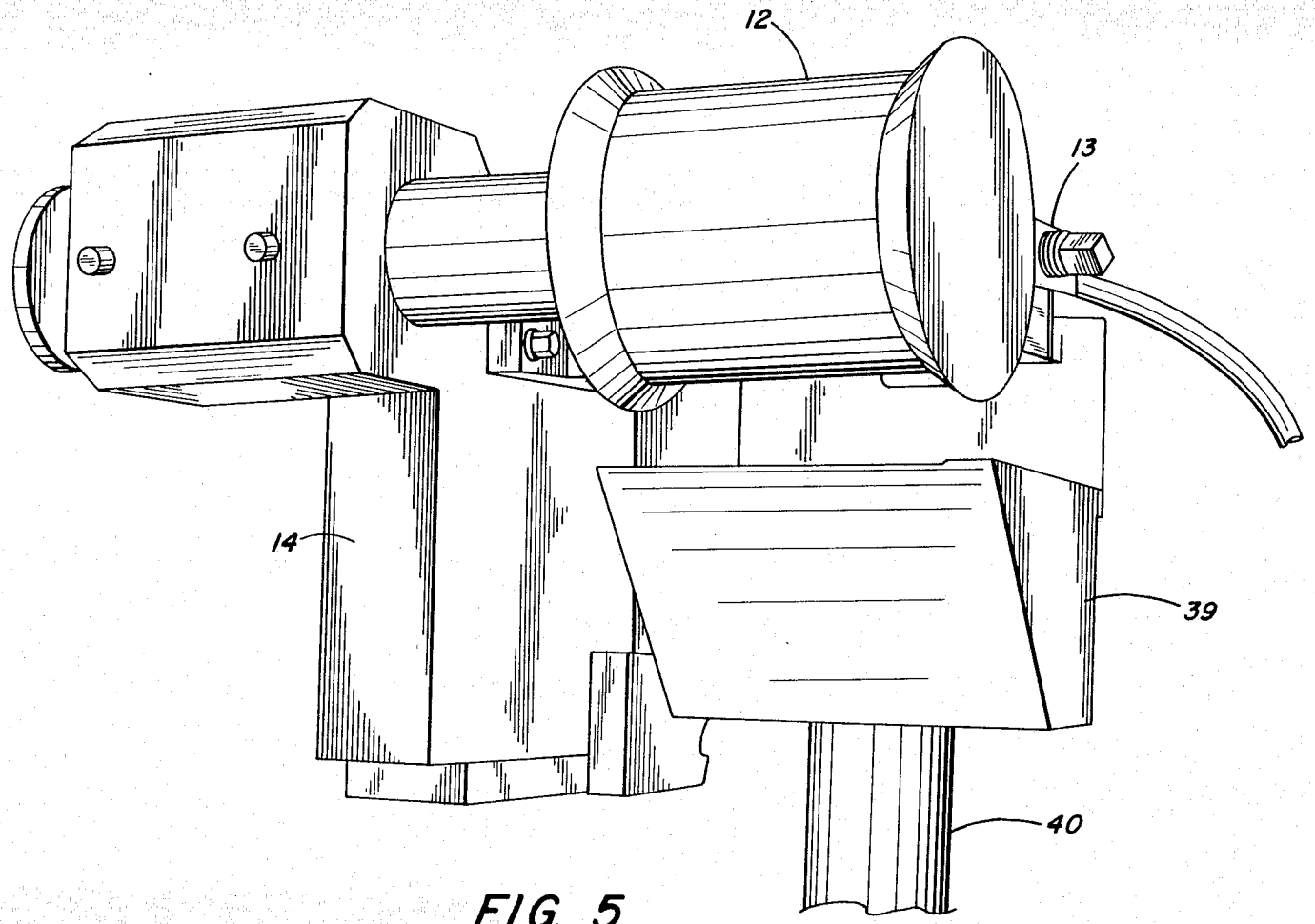
FIG. 5 is an off-centered front view of the support means with the rotating applicator means showing the collecting device beneath the rotating applicating means.

As is shown in FIG. 5, under rotatable applicating means 12 and delivery means 13, there can be located in spaced apart arrangement a collecting pan 39. The pan has sufficient dimensions to collect any chemical treatment that may fall or be displaced from either the rotating applicating means or the delivery means. The collecting pan may have conduit 40 to recycle or discard any displaced chemical treatment. The collecting pan 39 can be attached to support member 14. The pan 39 could also be replaced with a housing similar to housing 11 of FIG. 1 to surround the rotating applicating means and delivery means of FIG. 5 with an appropriate opening for conduit 17.

In the operation of the applicator of the instant invention, it is preferred to use the applicator in treating continuous glass filaments with chemical treatments such as aqueous sizing compositions containing film forming polymers, lubricants, coupling agents and the like. As is shown in FIGS. 1 through 5, the aqueous sizing solution is pumped into the delivery means 13 via conduit 17 from fluid control means 20. The housing or collecting pan is held firmly in place by sufficient attachment to the support member 14. The rotating shaft 26 or the rotating applicating means 13 is actuated by a suitable motor (not shown) and revolves between 60 to 180 revolutions per minute, preferably at 60 to 160 revolutions per minute. The applicating roll with a diameter that is preferably around 5.08 centimeters (2 inches) rotates in a counterclockwise direction in the same direction of travel as the continuous glass filaments to be treated with the aqueous size. The filaments 37 pass over the surface of the rotating applicator roll 12 which has aqueous solution on the cylindrical surface of applicator roll 12. The aqueous sizing solution is placed on the applicator roll 12 by delivery means 13 through slot 16 preferably at a location on the roll which is about 90 to 270 degrees away from the point where the filaments contact the rotating applicator roll. Preferably the delivery means 13 applies the aqueous sizing to a longitudinal portion of the surface of the cylindrical application roll 12 at a location on the roll which is about 180 degrees opposite where the filaments contact the cylindrical surface of the applicator roll 12. The aqueous sizing composition is metered through slot 12 through the supply of aqueous sizing composition from the fluid control means 20 through appropriate conduits. Preferably, the amount of sizing composition placed onto the applicator roll is just around that amount which is needed to provide a near continuous coating of the size for each filament contacting the rotating applicator roll. With such metering, the use of the housing 11 is not necessary and the pan 39 may be all that is needed to collect any displaced sizing composition. Although it may be desirable to use housing 11 to surround the rotating applicator means and delivery means 13 so that extraneous water from the cooling of the glass fibers immediately below the bushing through the orifices at which the glass fibers are attenuated. The aqueous sizing is applied from the delivery means to the surface of the rotating applicator means so that a constant feed of the sizing composition is on the surface of the rotating applicator means from the point of fluid contact between the sizing composition from slot 16 in delivery means 13 and the contact of the glass fibers to the rotating applicator roll 12. Filaments 37 are being attenuated from a fiber glass manufacturing bushing (not shown) at winding speeds of around 2,438.4 to 6,096 meters per minute or more and typically at speeds of around 2,682.24 to around 5,486.4 meters per minute. As the solution-ladened rotating applicator roll comes in contact with the filaments, the solution is picked up by the filaments which may be later gathered into strands. Since the filaments are traveling at high velocities in modern commercial installations such as the aforementioned winding speeds, considerable air turbulence is created at the entrance of housing 11 or around pan 39 but these high air currents do not reek havoc with any collected body of aqueous sizing composition because the applicator of the present invention does not have any reservoir of the sizing composition. The applicator of the present invention provides the needed aqueous sizing composition from the delivery means 13 directly to the rotating applicator means without the need for a reservoir of the aqueous sizing composition near the rotating applicator means. The source of the aqueous sizing composition can be at some distance from the forming and chemically treating area.

In order to allow sufficient flow of the aqueous sizing composition from the delivery means to the rotating applicator means, it is preferred that the slot of the delivery means has a length which is around the width of the fan of filaments contacting the rotating applicator roll 12 and the height of the slot is sufficient to form a meniscus of the aqueous sizing composition between the slot and the rotating applicator means. Preferably the dimensions of the slot are about 2 to 7 inches with a height of around 1/32 to ¾ of an inch.

EXAMPLE

One typical operation of the applicator of the present invention would involve an 800 whole fiber glass bushing that would be provided with molten glass continuously fed therethrough from a forehearth. The bushing would be operated to produce glass filaments having a diameter of around 0.000635 centimeters. These filaments would be drawn at a rate of around 4,876.8 meters per minute and the fan of filaments so drawn would pass in contact with the rotating applicator means 12 as shown in FIGS. 1 through 5. The delivery means 13 would supply a controlled amount through the fluid control means 20 of an aqueous sizing composition such as an amylose starch binder. The binder would flow through slot 16 of the delivery means, form a meniscus and contact the rotating applicator roll 12 at a longitudinal portion along the cylindrical surface of roller 12. Roller 12 would be driven at around 130 to 140 rpm. The filaments would contact the rotating applicator roll having the starch binder present by application from the slot in the delivery means. The treated filaments would be gathered and wound on a forming package. Very little binder blow back would be observed during such a run because of the absence of any reservoir of the binder to blown or splashed about. With the metering of just the required amount of binder for coating the glass fibers onto the rotating applicator roll at a rate of about 30 to 70 milliliters per minute, there would also be little binder blow off from the applicator roll. This is especially true if a housing is used rather than a pan. This would lead to a more uniform coating of the glass fibers with the binder and lead to a more uniform LOI (loss on ignition) of the binder on the glass fibers.

Thus, in utilizing the instant invention, strands of filaments drawn at high velocities over a rotating applicator roll, i.e. at around 2,438.4 meters per minute or more, although creating considerable air velocities in the vicinity of where the strands or filaments are treated with chemical treatments, little turbulence are present in any reservoir of chemical treatment since no reservoir of chemical treatment is present in the area.

In the embodiment shown, the applicator can be constructed of several pieces to form entire unit, i.e. a hinged top and hinged side, bottom and back wall for the housing. If desired, the housing 11 can be constructed of cast metal provided with an opening in the front, top and possibly a slot in the back or side walls to provide necessary pressure relieving means.

While the invention has been described with reference to certain specific embodiments, it will be understood that it should not be limited thereby except insofar as appears in the accompanying claims.

We claim:

1. An applicator for applying chemical treatment to filaments, comprising:

a. a support means positioned in proximity to a plurality of moving continuous filaments, b. cylindrical, rotatable applicating means with a flange at each end of the cylindrical surface, where the means is rotatably mounted in the support means in a horizontal position to contact the plurality of continuous filaments traveling by the applicating means, c. delivery means having a longitudinal slot leading from a cavity, where the slot is between tapered opposing corners adapted to fit between the flanges on the cylindrical surface of the applicating means so that the slot has a length to accommodate the longitudinal length of the cylindrical surface of the applicating means from the inside of one flange to the inside of the other flange, and where the delivery means is movably fastened to the support means to be in fluid contact with the rotatable applicating means when the opposing tapered corners are between the flanges of the rotatable applicating means to enable fluid chemical treatment supplied to the cavity of the delivery means to flow through the slot and contact the peripheral surface of the rotating applicating means so that the fluid chemical treatment can flow and contact a sufficient longitudinal portion of the peripheral surface of the cylindrical rotatable applicating means to transfer the chemical treatment to the plurality of moving filaments contacting the rotating applicating means, where the sufficient longitudinal portion is other than where the filaments contact the cylindrical rotatable applicating means, and d. fluid flow control means in fluid contact with the delivery means to supply a quantity of fluid chemical treatment to the cavity of the delivery means in order that a controlled continuous quantity of fluid chemical treatment flows through the slot of the delivery means to contact a peripheral longitudinal portion of the rotatable applicating means that is rotating to carry the chemical treatment to contact the plurality of moving continuous filaments.

2. Applicator of claim 1, which includes a housing surrounding the rotating applicating means and delivery means and having an opening for the fluid control means to provide fluid to the delivery means and having an opening through which a portion of the rotating applicator means protrudes to contact continuous filaments, where the housing is attached to the support means.

3. Applicator of claim 2, wherein the housing is in hinged attachment with the support means so that the top of the housing can be lifted away from the other portions of the housing.

4. Applicator of claim 1, which includes a catch means attached to the support means under the rotatable applicating means and delivery means to catch any discarded fluid chemical treatment.

5. Applicator of claim 1, wherein the one or more filaments contact the rotatable applicating means at a position about 90 to 270 degrees away from where the delivery means through fluid contact supplies fluid to the rotating applicator means.

6. Applicator of claim 1, wherein the longitudinal slot between the tapered opposing corners has a length of about 2 to 7 inches and a height of around 1/32 to ¾ of an inch.

7. Applicator of claim 1, wherein the one or more continuous filaments contact the rotatable applicating means at a position of 180 degrees away from where the delivery means through fluid contact supplies fluid to the rotating applicating means.

8. Applicator of claim 1, wherein the fluid contact between the cylindrical rotatable applicating means and the delivery means having tapered opposing corners adapted to fit between the flanges of the cylindrical rotating applicating means is a gap of around 0.001 inch.

9. Applicator of claim 1, wherein the longitudinal slot has a length that is around the width of one or more filaments to be treated with the chemical treatment and around the width of the fan of filaments when a plurality of filaments is to be treated with the chemical treatment and a height sufficient to form a meniscus of the fluid chemical treatment between the slot and the rotatable applicating means.

* * * * *

UNITED STATES PATENT AND TRADEMARK OFFICE

CERTIFICATE OF CORRECTION

PATENT NO. : 4,517,916

DATED : May 21, 1985

INVENTOR(S) : Herbert W. Barch et al.

It is certified that error appears in the above-identified patent and that said Letters Patent is hereby corrected as shown below:

On the title page;

First page [75] Inventors: Herbert W. Barch, Natrona Heights; George T. Salego, Brackenridge; Rudolph Blair, Gibsonia, all of Pa.

Should read:

[75] Inventors: Herbert W. Barch, Natrona Heights; George T. Salego, Brackenridge; Rudolph Blair, Gibsonia; William H. Retsch, Castle Shannon, all of Pa.

Signed and Sealed this

*Twentieth* Day of *August 1985*

[SEAL]

*Attest:*

DONALD J. QUIGG

*Attesting Officer* *Acting Commissioner of Patents and Trademarks*